US009611841B2

(12) United States Patent
Antoun

(10) Patent No.: US 9,611,841 B2
(45) Date of Patent: Apr. 4, 2017

(54) PUMPING OF COLLECTED LIQUIDS IN SYSTEMS

(71) Applicant: Gregory S. Antoun, Meadville, PA (US)

(72) Inventor: Gregory S. Antoun, Meadville, PA (US)

( * ) Notice: Subject to any disclaimer, the term of this patent is extended or adjusted under 35 U.S.C. 154(b) by 236 days.

(21) Appl. No.: 13/773,720

(22) Filed: Feb. 22, 2013

(65) Prior Publication Data

US 2014/0238499 A1 Aug. 28, 2014

(51) Int. Cl.
*F04B 17/00* (2006.01)
*F04B 23/02* (2006.01)

(52) U.S. Cl.
CPC ..... *F04B 23/02* (2013.01); *Y10T 137/0379* (2015.04); *Y10T 137/86035* (2015.04)

(58) Field of Classification Search
CPC ..... F04B 9/107
USPC ..... 417/392, 379, 383–385
See application file for complete search history.

(56) References Cited

U.S. PATENT DOCUMENTS 1,936,853 A * 11/1933 Ofeldt ..... F02B 1/00 137/533.11
1,936,858 A * 11/1933 Rennerfelt ..... 29/893.1
2,731,044 A * 1/1956 Schwabe ..... D03D 45/20 139/223
2,828,694 A * 4/1958 Nallinger ..... 417/328
3,131,640 A * 5/1964 Rohde et al. ..... 417/392
4,030,857 A * 6/1977 Smith, Jr. ..... B05B 9/0409 417/390
4,342,543 A * 8/1982 Allen et al. ..... 417/211.5
5,114,318 A * 5/1992 Freeborn ..... F03G 6/00 417/379

FOREIGN PATENT DOCUMENTS

FR 521443 * 11/1919

* cited by examiner

*Primary Examiner* — Charles Freay
(74) *Attorney, Agent, or Firm* — Bartony & Associates, LLC

(57) ABSTRACT

A system includes at least one fluid volume in which pressure varies, a retention volume for collecting a liquid used in operating the system; and a pump device in fluid connection with the retention volume and in operative connection with the fluid volume. The pump device includes a housing, a movable pressurizing mechanism within the housing and in fluid connection with the fluid volume, a biasing mechanism in operative connection with the pressurizing mechanism to bias the pressurizing mechanism in a first direction, and a pump volume within the housing. The volume of the pump volume is defined by a position of the pressurizing mechanism, wherein the position of the pressurizing mechanism is controlled by pressure within the fluid volume and the biasing mechanism. The pump device further includes an inlet port in fluid connection with the pump volume and an outlet port in fluid connection with the pump volume.

18 Claims, 5 Drawing Sheets

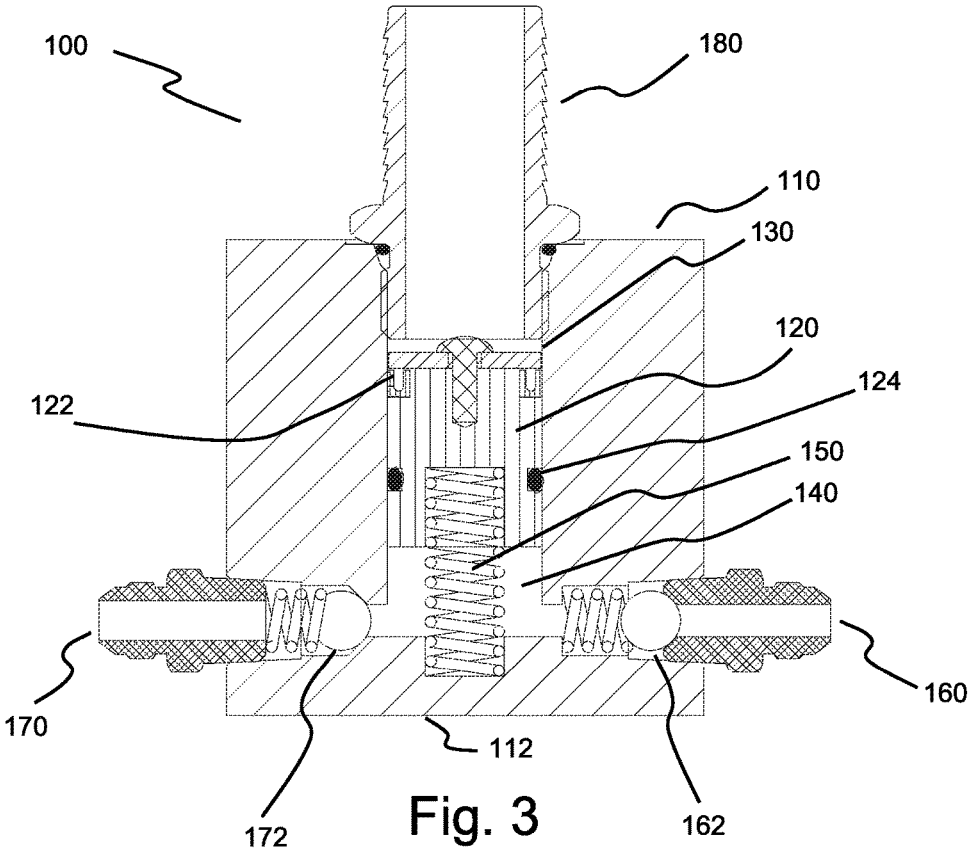
Fig. 3
FIG. 4A
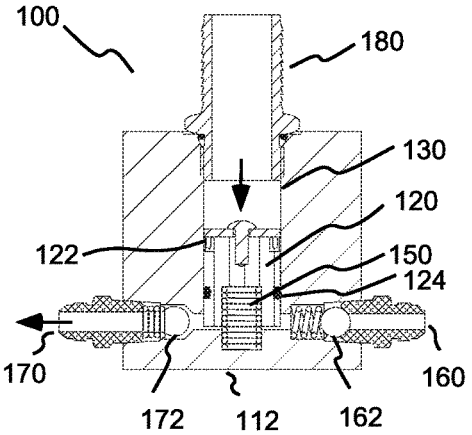
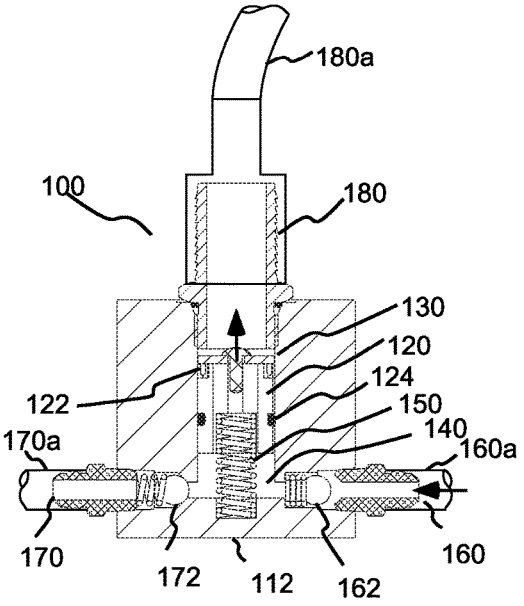
FIG. 4B

PUMPING OF COLLECTED LIQUIDS IN SYSTEMS

BACKGROUND OF THE INVENTION

The following information is provided to assist the reader in understanding technologies disclosed below and the environment in which such technologies may typically be used. The terms used herein are not intended to be limited to any particular narrow interpretation unless clearly stated otherwise in this document. References set forth herein may facilitate understanding of the technologies or the background thereof. The disclosure of all references cited herein are incorporated by reference.

In many types of systems, liquids are used that may be dripped, spilled, leaked or otherwise freed from containment during operation of the system. Such liquids include, for example, lubricants, coolants etc., which are used in many systems (for example, machining systems, grinding systems etc.). In current processes, a container such as a pan is provided to collect such fluids. Typically, the fluid is controlled or recovered by manually emptying the collection pan on a periodic basis.

SUMMARY OF THE INVENTION

In one aspect, a system includes at least one fluid volume in which pressure varies, a retention volume for collecting a liquid used in operating the system; and a pump device in fluid connection with the retention volume and in operative connection with the fluid volume. The pump device includes a housing, a movable pressurizing mechanism within the housing and in fluid connection with the fluid volume, a biasing mechanism in operative connection with the pressurizing mechanism to bias the pressurizing mechanism in a first direction, and a pump volume within the housing. The volume of the pump volume is defined by a position of the pressurizing mechanism, wherein the position of the pressurizing mechanism is controlled by pressure within the fluid volume and the biasing mechanism. The pump device further includes an inlet port in fluid connection with the pump volume and an outlet port in fluid connection with the pump volume. The pump device may further include a first check valve in operative connection with the inlet port and a second check valve in fluid connection with the outlet port. The pressurizing mechanism may, for example, be in fluid connection with the fluid volume via a closed loop.

In a number of embodiments, the pressurizing mechanism is a piston. The piston may, for example, be reciprocally movable within a cylinder within the housing of the pump. The system may further include at least one seal to form a sealed connection between the piston and the cylinder. The biasing mechanism may, for example, include a spring and/or other resilient biasing member(s).

In a number of embodiments, the biasing mechanism is in operative connection with a first side of the pressurizing mechanism and the fluid volume is in operative connection with a second side of the pressurizing mechanism. Movement of the pressurizing mechanism in the first direction causes the pump volume to increase and liquid from the retention volume to be drawn into the pump volume, and movement of the pressurizing mechanism in a second direction, generally opposite the first direction, causes the pump volume to decrease and liquid to be pumped from the pump volume through the outlet port.

In another aspect, a method of recovering a liquid used in a system, wherein the system includes a fluid volume in which pressure is varied and a retention volume for collecting the liquid, includes placing a pump device in fluid connection with the retention volume. The pump device includes a housing; a movable pressurizing mechanism within the housing and in fluid connection with the fluid volume, a biasing mechanism in operative connection with the pressurizing mechanism to bias the pressurizing mechanism in a first direction, a pump volume within the housing, the volume of the pump volume being defined by a position of the pressurizing mechanism; an inlet port in fluid connection with the pump volume; and an outlet port in fluid connection with the pump volume. The method further includes placing the pressurizing mechanism in operative connection with the fluid volume so that the position of the pressurizing mechanism is controlled by pressure within the fluid volume and the biasing mechanism. The pump device may further include a first check valve in operative connection with the inlet port and a second check valve in fluid connection with the outlet port. As described above, the pressurizing mechanism may, for example, be in fluid connection with the fluid volume via a closed loop.

In a number of embodiments of methods hereof, the pressurizing mechanism is a piston. The piston may, for example, be reciprocally movable within a cylinder within the housing of the pump. In a number of embodiments, the pump device further includes at least one seal to form a sealed connection between the piston and the cylinder. The biasing mechanism may, for example, include a spring and/or other resilient biasing member(s).

As described above, in a number of embodiments, the biasing mechanism is in operative connection with a first side of the pressurizing mechanism and the fluid volume is in operative connection with a second side of the pressurizing mechanism. Movement of the pressurizing mechanism in the first direction causes the pump volume to increase and liquid from the retention volume to be drawn into the pump volume, and movement of the pressurizing mechanism in a second direction, generally opposite the first direction, causes the pump volume to decrease and liquid to be pumped from the pump volume through the outlet port.

In a number of embodiments, the liquid is pumped by the pump device to be recycled for use in the system or another system. The liquid may, for example, include a lubricant. In other embodiments, the liquid is pumped by the pump device to be discarded as waste.

In a further aspect, a pump device powerable by changes in pressure in a fluid volume of a system, includes a housing, a movable pressurizing mechanism within the housing, a biasing mechanism in operative connection with the pressurizing mechanism to bias the pressurizing mechanism in a first direction, a fluid connection in operative connection with the pressurizing mechanism to place the pressurizing mechanism in operative connection with the fluid volume of the system, a pump volume within the housing, wherein the volume of the pump volume is defined by a position pressurizing mechanism wherein the position of the pressurizing mechanism is controlled by pressure within the fluid line and the biasing mechanism, an inlet port in fluid connection with the pump volume, and an outlet port in fluid connection with the pump volume. The pump device may, for example, further include a first check valve in operative connection with the inlet port and a second check valve in fluid connection with the outlet port. The pressurizing mechanism may, for example, be in fluid connection with the fluid volume via a closed loop.

In a number of embodiments, the pressurizing mechanism is a piston. The piston may, for example, be reciprocally movable within a cylinder within the housing of the pump. The pump may, for example, further include at least one seal to form a sealed connection between the piston and the cylinder. The biasing mechanism may, for example, include a spring and/or other resilient member(s).

In a number of embodiments, the biasing mechanism is in operative connection with a first side of the pressurizing mechanism and the fluid volume is in operative connection with a second side of the pressurizing mechanism. Movement of the pressurizing mechanism in the first direction causes the pump volume to increase and liquid from a liquid source to be drawn into the pump volume. Movement of the pressurizing mechanism in a second direction, generally opposite the first direction, causes the pump volume to decrease and liquid to be pumped from the pump volume through the outlet port.

The present invention, along with the attributes and attendant advantages thereof, will best be appreciated and understood in view of the following detailed description taken in conjunction with the accompanying drawings.

BRIEF DESCRIPTION OF THE DRAWINGS

FIG. 3 illustrates a side, cross-sectional view of the pump device along section A-A of FIG. 2.

FIG. 4A illustrates a side, cross-sectional view of the pump device along section A-A of FIG. 2 wherein a piston of the pump device is moving forward or downward in a pumping stage.

FIG. 4B illustrates a side, cross-sectional view of the pump device along section A-A of FIG. 2 wherein the piston of the pump device is moving rearward or upward in a filling stage.

DETAILED DESCRIPTION OF THE INVENTION

Figure 1:
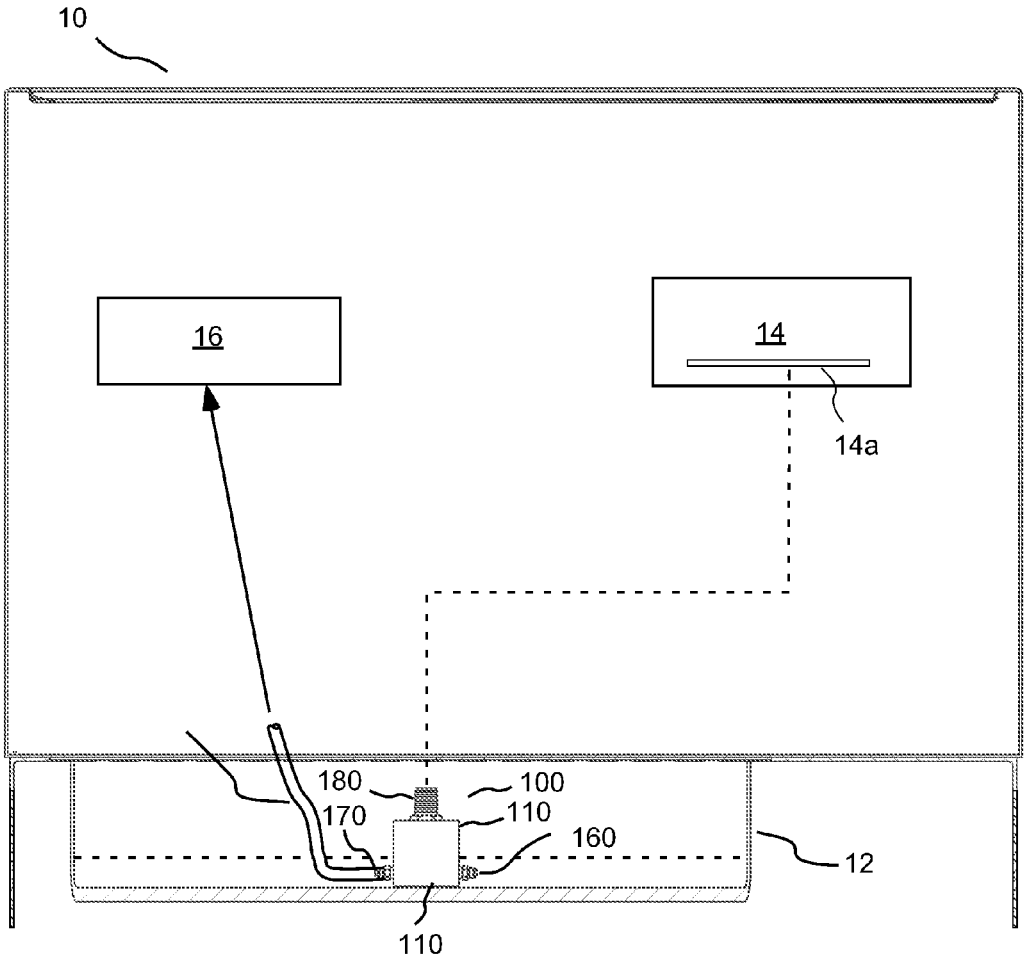
FIG. 1 illustrates a system including an embodiment of a pump device or system hereof, wherein the system is shown in cross section.
Figure 2:
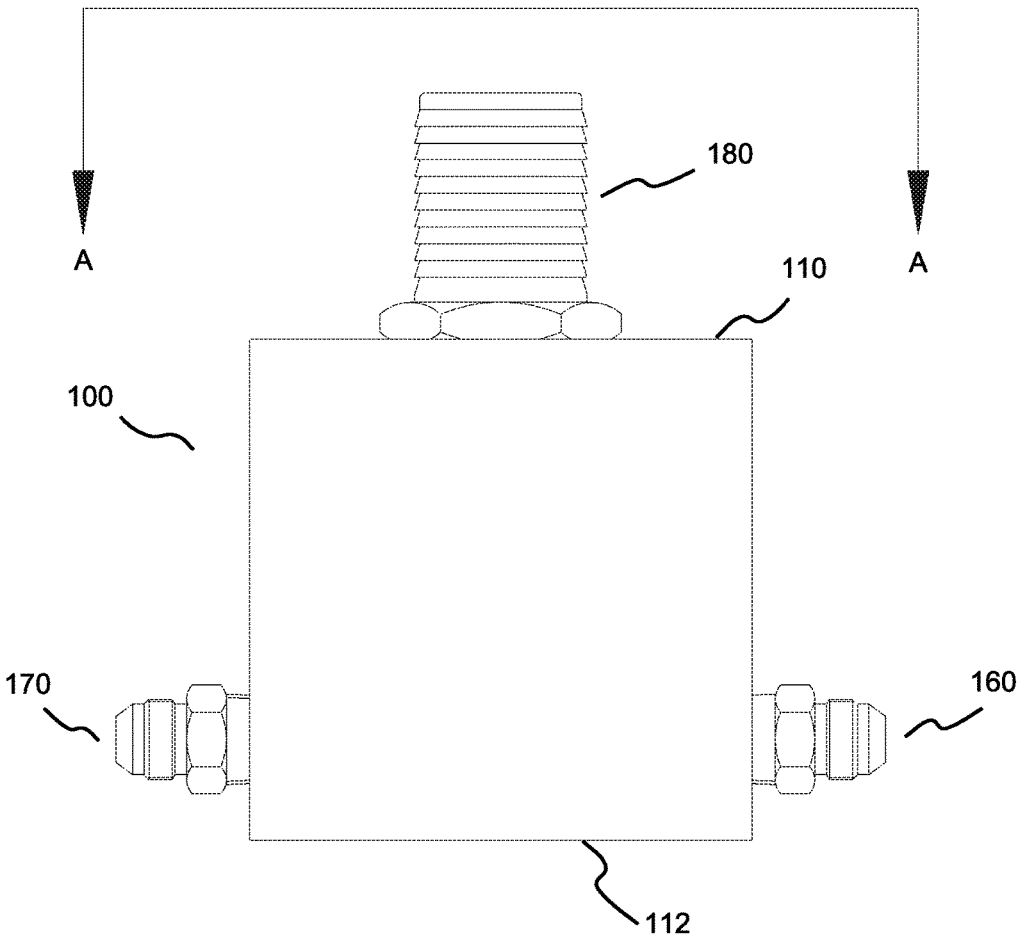
FIG. 2 illustrates a side view of the pump device of FIG. 1.

It will be readily understood that the components of the embodiments, as generally described and illustrated in the figures herein, may be arranged and designed in a wide variety of different configurations in addition to the described example embodiments. Thus, the following more detailed description of the example embodiments, as represented in the figures, is not intended to limit the scope of the embodiments, as claimed, but is merely representative of example embodiments.

Reference throughout this specification to "one embodiment" or "an embodiment" (or the like) means that a particular feature, structure, or characteristic described in connection with the embodiment is included in at least one embodiment. Thus, the appearance of the phrases "in one embodiment" or "in an embodiment" or the like in various places throughout this specification are not necessarily all referring to the same embodiment.

Furthermore, described features, structures, or characteristics may be combined in any suitable manner in one or more embodiments. In the following description, numerous specific details are provided to give a thorough understanding of embodiments. One skilled in the relevant art will recognize, however, that the various embodiments can be practiced without one or more of the specific details, or with other methods, components, materials, et cetera. In other instances, well known structures, materials, or operations are not shown or described in detail to avoid obfuscation.

As used herein and in the appended claims, the singular forms "a," "an", and "the" include plural references unless the context clearly dictates otherwise. Thus, for example, reference to "a piston" includes a plurality of such pistons and equivalents thereof known to those skilled in the art, and so forth, and reference to "the piston" is a reference to one or more such pistons and equivalents thereof known to those skilled in the art, and so forth.

In a number of embodiments, pumping devices, systems and/or methods hereof enable, for example, recovery of (that is, controlling the location of, reclamation of and/or recycling of) amounts of a liquid from a pan, tank or other container in a system in which "freeing", "dripping" or "leaking" of the liquid occurs so that the liquid may, for example, be recovered. In a number of embodiments, the liquid is reclaimed and/or recycled for its original intended use. In a number of representative embodiments hereof, devices, systems and/or methods hereof are, for example, used to provide intermittent lubrication by recycling a lubricant liquid that has dripped or leaked into a collection container or pan. In other embodiments, the liquid may be transported as waste to, for example, a container or reservoir.

In a number of such embodiments, pressure changes caused, for example, by changes in an operational state of a system (in connection with which a pump device or devices hereof are operating) are used to power the pumping device(s). For example, each time a certain state change (for example, starting, stopping, an on/off actuation, a mode change etc.) occurs in a pressurizing or pressurized system (for example, including a system pump) of a device or system in connection with which a pump device or system hereof is used, the associated pressure change may be used to cause a volume of liquid to be pumped from, for example, a retention volume such as a collection pan or other container to any part of the device or system or to an ancillary device or system. No external mechanical linkages (that is, bodies or members to manage force and movement) are required to be connected to the pumping devices or systems hereof. Likewise, no electrical or other external power connections are required. All power used to drive the pump devices hereof is obtained from pressure changes occurring in the normal operation of the system(s) to which the pump devices hereof are operatively connected.

FIGS. 1 through 4B illustrate a representative embodiment of a pumping device or system 100 hereof positioned within a coolant, lubrication or other collected liquid pan 12 of a system 10. System 10 includes a pressurized or pressurizing system 14 which, may, for example, include one or more pumps and pressurized fluid volumes 14*a* (for example, a fluid line). For example, pressurized system 14 may, for example, be a coolant liquid system and system 10 may, for example, be a machining or grinding system. In the illustrated embodiment, pumping device 100 includes a pump housing 110 in which a movable pressurizing mechanism such as a piston 120 is movably positioned. Pressurizing mechanisms other than a piston (for example, a diaphragm or bladder) may be used. Piston 120 may, for example, include one or more seals to form a sealing engagement with a cylinder 130 in which piston 120 is reciprocally movable. In the illustrated embodiment, piston 120 includes a lip seal 122 and an annular seal such an O-ring 124 to form a sealing engagement between piston 120 and cylinder 130. Use of such seals are known to those skilled in the art of pressurizing pistons. A pump volume, space or cavity 140 (below piston 120 in the illustrated embodiment) is maintained at a certain volume by the biasing force created by a biasing mechanism such as spring 150 when there is no pressure exerted upon piston 120. In other words, piston 120 or other pressurizing mechanism hereof is biased in a first direction as illustrated in FIG. 3. Biasing mechanism other than springs (for example, elastomeric members, fluid or pneumatic systems etc.) may be used herein. In general, extensible or compressible biasing mechanisms which do not require power input (for example, electrical power, chemical power etc.) are used in a number of embodiments hereof.

Pumping device 100 further includes an inlet port 160 and an outlet port 170 in fluid connection with pump volume 140. Each of inlet port 160 and outlet port 170 includes a one-way or check valve 162 and 172, respectively. In the illustrated embodiment, each check valve 162 and 172 is a ball valve which includes a ball biased (for example, by a spring) to close inlet port 160 and outlet port 170, respectively.

Piston 120 of pumping device 100 is in operative or fluid connection with pressurized system 14 via a fluid connector 180. When a positive fluid pressure is exerted upon an upper surface of piston to overcome the rearward or upward biasing force exerted by spring 150, piston 120 is forced forward or downward (in the illustrated orientation) toward a base section 112 of housing 120. As, for example, illustrated in FIG. 4A, as piston 120 is moved forward toward base section 112, the size (volume) of pump volume 140 is decreased, and pressure increases within pump volume 140. The increase in pressure in pump volume 140 causes check valve 172 to open so that fluid from pump volume 140 is pumped through outlet port 170. The pressure within pump volume 140, however, maintains check valve 162 in a closed position. When fluid pressure exerted upon piston 120 by pressurized system 14 is decreased, biasing spring 150 forces piston 120 rearward or upward (away from base section 112), increasing the size (volume) of pump volume 140. The resultant decrease in pressure within pump volume 140 causes check valve 162 to open (as, for example, illustrated in FIG. 4B), and fluid is drawn into pump volume 140 via inlet port 160. Check valve 172 remains closed during rearward or upward movement of piston 120.

In a number of representative embodiments as described above, pressurized system 14 is a coolant system. Each time coolant system 14 is activated, an increase in pressure forces piston 120 downward, compressing spring 150. For example, a liquid pressure resulting from activation of coolant system 14 may be 60 pounds per square inch (psi). As piston 120 is forced toward base section 112, it creates a downward or forward pump stroke that forces liquid from pump volume 140 out through outlet port 170 to a system 16 (see FIG. 1). When coolant system 14 is, for example, deactivated, the pressure on piston 120 is removed, and spring 150 forces piston 120 away from base section 120 in a rearward or upward stroke as described above. Liquid from pan 12 is thereby drawn into pump volume 140 via inlet port 160. Each increase in pressure results in a forward or downward pump stroke that causes liquid to be forced out of pump device 100 via outlet port 170, and each reduction in pressure causes a rearward or upward stroke (powered by spring 150) wherein liquid is drawn into pump device 100 via inlet port 160.

Pump device 100 may, for example, be used to remove drainage in the bottom of pan 112, in system 10. Such liquid (for example, a coolant or lubricant) may, for example, be recovered and pumped to a device or system such as system 16 for recycled use. In other embodiments, the liquid may be recovered and pumped to, for example, a waste container or reservoir. Pump device 100 may thereby assist in maintaining environmental control of any liquids that, in previously available systems, had run over onto the floor or had to be removed manually.

Pump device 100 may, for example, be powered by any fluid flow (which has at least one state wherein the flow is under suitable pressure to overcome the biasing force of spring 150 or other biasing mechanism) in the machine, device or system in connection with which pump device 100 is used. No fluids need be exchanged between the powering fluid flow and the fluid pumped by pump device 100. A closed loop can be used to power pumping device 100.

Pump device 100 may be connected and operated almost anywhere along, for example, a flow or fluid line of other pressurized volume of a system. Hydraulically, the fluid will exerts essentially the same force anywhere along the flow line, minus, for example, frictional losses. Further, there is almost no frictional loss resulting in pump device 100 as a result of the small amount of flow required to power piston 120. Therefore, the distance that the pressurizing/powering fluid is pumped or the distance from the pump supplying the pressurizing/powering fluid are not normally determining factors in the function of this device. Additionally, chemical interactions, electrical connections or other issues are typically not important in pumping device 100. Seals such as seals 122 and 124 may, for example, be configured in many ways that are currently known in the pumping industry. The seal materials may be readily matched to the fluids that will be pumped. Seals that are chemically resistant (for example, oil resistant) are readily available.

Using well established engineering principles, pump device 100 may be tuned to a wide variety of input pressures from system 14. Variables that may be readily determined include, but are not limited to, input pressure change, the biasing force of the biasing mechanism, system component dimensions and materials, and flow rates into and out of the pump device 100. The volume of liquid pumped with each stroke of piston 120 can vary over a very broad range. For example, the liquid pumped with each piston stroke can vary between 1 and 1000 ml. In a number of embodiments, the liquid pumped with each piston stroke varied between approximately 10 and 30 ml.

The lengths of fluid connections such as hosing or tubing 160*a* (in fluid connection with inlet port 160 and pan 112), hosing or tubing 170*a* (in fluid connection with outlet port 170*a* and the destination reservoir for the liquid pumped from pan 112) and hosing or tubing 180*a* (in fluid connection with fluid connector 180 and with a fluid line of system 14) as, for example, illustrated in FIG. 4B, may be varied independently over a wide range (for example, from millimeters to many meters). This variability in fluid connection provides substantial flexibility for the location of pump device 100. Pump device 100 may, for example, be placed in venues that are very difficult to reach by or even hazardous to personnel.

Pump device 100 thus allows the use of power derived from a fluid that is already being pumped within a system with relatively small amounts of energy used to recover liquid that, for example, drips into a collection area or volume. As described above, in a number of embodiments, pump device 100 may deliver a relatively small amount of a lubricant to one or more systems upon the occurrence of a state change (for example, when a system is activated or turns on). Collected liquid may also be pumped by pump device 100 to a reservoir from which it may, for example, be recycled, further processed or discarded. Pump device 100 is inexpensive to manufacture and to operate, while providing significant reliability, durability and reduced labor costs.

Figure 5A:
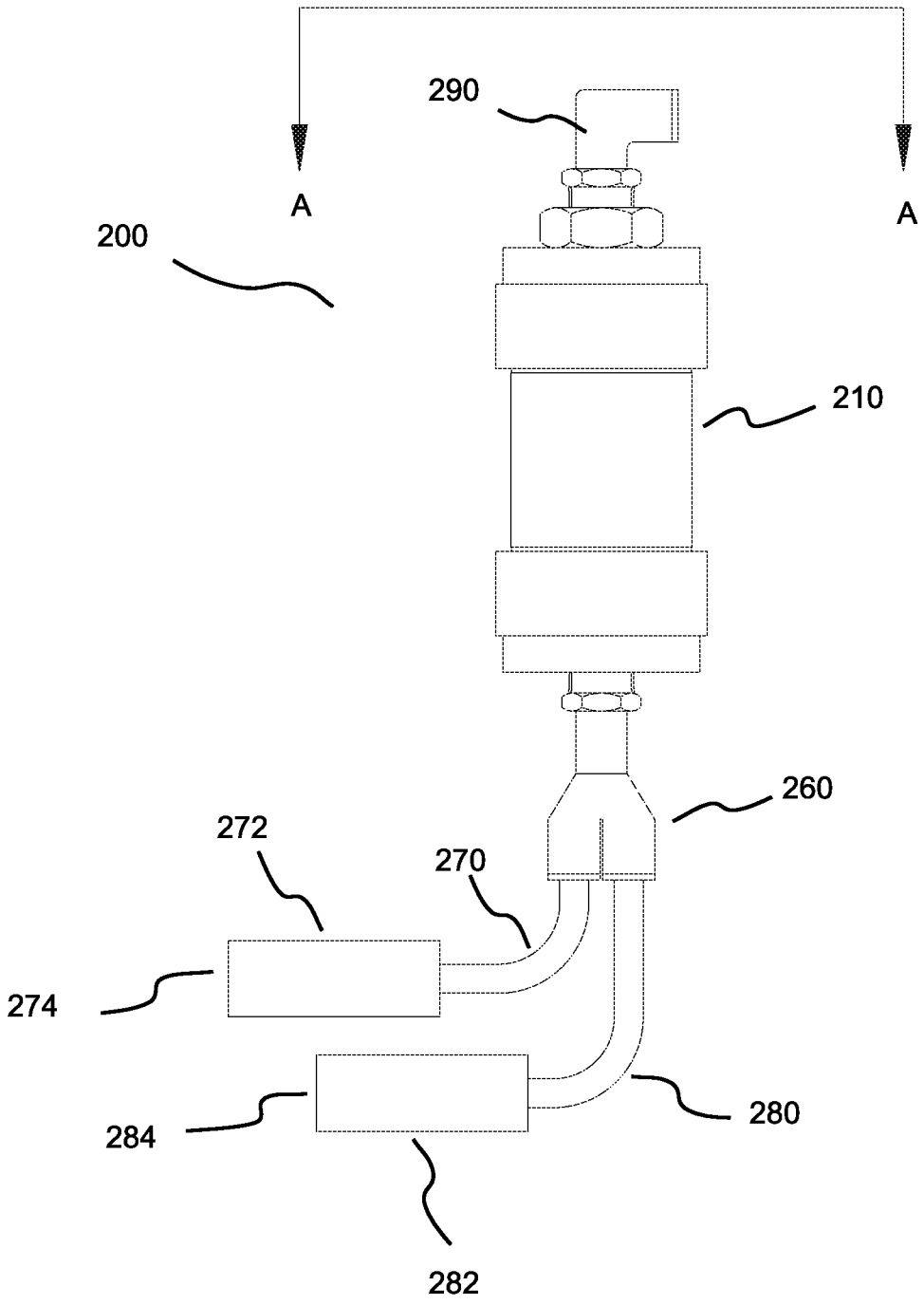
FIG. 5A illustrates a side view of another embodiment of a pump device or system hereof
Figure 5B:
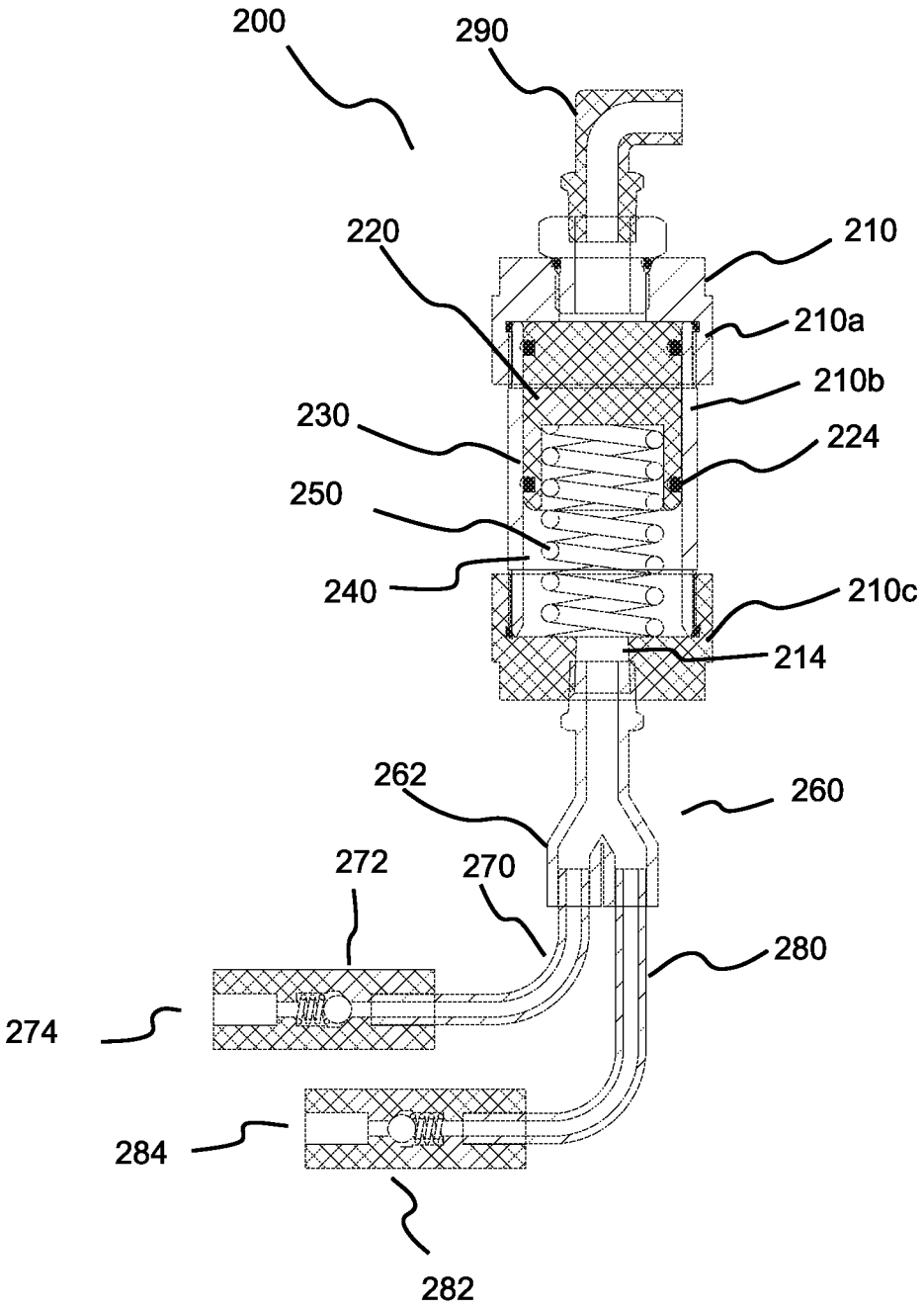
FIG. 5B illustrates a side, cross-sectional view of the pump device or system of FIG. 5A along section A-A of FIG. 5A.

FIGS. 5A and 5B illustrate another representative embodiment of a pumping device or system 200 hereof. Similar to pumping device 100, pumping device 200 includes a pump housing 210 in which a movable pressurizing mechanism such as a piston 220 is movably positioned. In the illustrated embodiment, housing 210 is form in three sections 210*a*, 210*b* and 210*c* may, for example, be formed from any suitable material (for example, polymeric materials, metallic materials etc.) and may, for example, be connected via cooperating threaded portions, adhesives etc. Piston 220 may, for example, include one or more seals 224 (for example, one or more O-rings) to form a sealing engagement with a cylinder 230 in which piston 220 is reciprocally movable. A pump volume 240 (below piston 220 in the orientation of the illustrated embodiment) is maintained at a certain volume by the biasing force created by a biasing mechanism such as spring 250 when there is no pressure exerted upon piston 220.

Pumping device 200 further includes a flow path or system 260, which is placed in fluid connection with volume 240 via a port 214 formed in housing 210 (in housing section 210*c* in the illustrated embodiment). Flow system 260 may, for example, be connected to port 210 via cooperating threaded fittings, an adhesive, a snap fit etc. In the illustrated embodiments, flow path 260 includes an inlet conduit 270 in fluid connection with a check valve 272, which includes an inlet port 274. Flow path 260 further includes an outlet conduit in fluid connection with a check valve 282 including an outlet port 284. an inlet port 160 and an outlet port 170 in fluid connection with pump volume 140. In the illustrated embodiment, each one-way check valve 272 and 282 include a ball valve as described above (which includes a ball biased (for example, by a spring) to close inlet port 274 and outlet port 284, respectively, as described above in connection with check valves 162 and 172.

A number of currently available pump devices are powered by electric motors. In many cases, such pump devices can be non-water tight and/or non-oil tight. In general, such devices are significantly less reliable than pump device 100 and other pump devices hereof. Moreover, unlike the pump devices hereof, pump devices including electrical motor and associated check valves can lose their prime. Pump device 100 and other pump devices hereof will not lose prime. Pump devices hereof (which may, for example, sit at the bottom of a tank or a drip pan) can function against spring 150 or other biasing mechanism if there is only air/gas present in pump volume 140, if there is combination of air and liquid present in pump volume 140 or if only liquid is present in pump volume 140. Pump devices hereof are self-priming and do not require electrical switches, liquid level sensors, or motors, resulting in increased mechanically reliable as compared to other pump devices.

The foregoing description and accompanying drawings set forth the preferred embodiments of the invention at the present time. Various modifications, additions and alternative designs will, of course, become apparent to those skilled in the art in light of the foregoing teachings without departing from the scope of the invention. The scope of the invention is indicated by the following claims rather than by the foregoing description. All changes and variations that fall within the meaning and range of equivalency of the claims are to be embraced within their scope.

What is claimed is:

1. A system, comprising:

a first liquid used in operating the system, a second liquid being contained within a fluid volume in which pressure of the second liquid varies in the fluid volume upon a change in operating state of the system, including upon a change from an on state to an off state;

a drip pan for collecting the first liquid which is freed during operating the system; and a pump device in fluid connection with the drip pan and in operative connection with the fluid volume, the pump device comprising:

a housing;

a movable pressurizing mechanism within the housing powered by a closed system in which the movable pressurizing mechanism is in fluid connection with the fluid volume via a closed fluid path wherein no fluid is exchanged between the fluid volume and a pump volume within the housing or between the fluid volume and the environment via the closed fluid path;

a biasing mechanism in operative connection with the pressurizing mechanism to bias the pressurizing mechanism in a first direction; a volume of the pump volume being defined by a position of the pressurizing mechanism wherein the position of the pressurizing mechanism is controlled by pressure within the fluid volume and the biasing mechanism, wherein pressure variation in the fluid volume upon a change in the operating state of the system causes a change in the position of the pressurizing mechanism, including upon the change from the on state to the off state;

an inlet port in fluid connection with the pump volume and in fluid connection with the liquid within the drip pan; and an outlet port in fluid connection with the pump volume and in fluid connection with a recovery volume into which the liquid within the drip pan is pumped via the pump device.

2. The system of claim 1 wherein the pump device further comprises a first check valve in operative connection with the inlet port and a second check valve in fluid connection with the outlet port.

3. The system of claim 2 wherein the pressurizing mechanism is a piston.

4. The system of claim 3 wherein the piston is reciprocally movable within a cylinder within the housing of the pump.

5. The system of claim 4 further comprising at least one seal to form a sealed connection between the piston and the cylinder.

6. The system of claim 4 wherein the biasing mechanism comprises a spring.

7. The system of claim 2 wherein the biasing mechanism is in operative connection with a first side of the pressurizing mechanism and the fluid volume is in operative connection with a second side of the pressurizing mechanism, and wherein movement of the pressurizing mechanism in the first direction causes the pump volume to increase and liquid from the drip pan to be drawn into the pump volume, and movement of the pressurizing mechanism in a second direction, generally opposite the first direction, causes the pump volume to decrease and liquid to be pumped from the pump volume through the outlet port.

8. The system of claim 1 wherein the first liquid and the second liquid are the same.

9. A method of recovering a first liquid selected from a coolant and a lubricant used in a system, the system including a fluid volume in which pressure is varied in the fluid volume upon a change in operating state of the system, including upon a change from an on state to an off state, and a drip pan for collecting the liquid freed during operation of the system, the method comprising:

placing a pump device in fluid connection with the drip pan, the pump device comprising: a housing; a movable pressurizing mechanism within the housing and in fluid connection with the fluid volume via a closed fluid path wherein no fluid is exchanged between the fluid volume and a pump volume within the housing or between the fluid volume and the environment via the closed fluid path, a biasing mechanism in operative connection with the pressurizing mechanism to bias the pressurizing mechanism in a first direction, a volume of the pump volume being defined by a position of the pressurizing mechanism; an inlet port in fluid connection with the pump volume and in fluid connection with the liquid in the drip pan; and an outlet port in fluid connection with the pump volume and in fluid connection with a recovery volume; and placing the pressurizing mechanism in operative connection with the fluid volume so that the position of the pressurizing mechanism is controlled by pressure within the fluid volume and the biasing mechanism upon a change in operating state of the system, including upon the change from the on state to the off state.

10. The method of claim 9 wherein the pump device further comprises a first check valve in operative connection with the inlet port and a second check valve in fluid connection with the outlet port.

11. The method of claim 10 wherein the pressurizing mechanism is a piston.

12. The method of claim 11 wherein the piston is reciprocally movable within a cylinder within the housing of the pump.

13. The method of claim 12 wherein the pump device further comprising at least one seal to form a sealed connection between the piston and the cylinder.

14. The method of claim 12 wherein the biasing mechanism comprises a spring.

15. The method of claim 10 wherein the biasing mechanism is in operative connection with a first side of the pressurizing mechanism and the fluid volume is in operative connection with a second side of the pressurizing mechanism, and wherein movement of the pressurizing mechanism in the first direction causes the pump volume to increase and the first liquid from the drip pan to be drawn into the pump volume, and movement of the pressurizing mechanism in a second direction, generally opposite the first direction, causes the pump volume to decrease and the first liquid to be pumped from the pump volume through the outlet port to the recovery volume.

16. The method of claim 10 wherein the first liquid is pumped by the pump device to be recycled for use in the system or another system.

17. The method of claim 16 wherein the first liquid is the coolant.

18. The method of claim 10 wherein the first liquid is pumped by the pump device to the recovery volume to be discarded as waste.

* * * * *